United States Patent [19]

Blytas

[11] 4,116,820

[45] Sep. 26, 1978

[54] PROCESS FOR DEMETALLIZING OF HEAVY HYDROCARBONS

[75] Inventor: George C. Blytas, Houston, Tex.

[73] Assignee: Shell Oil Company, Houston, Tex.

[21] Appl. No.: 811,235

[22] Filed: Jun. 29, 1977

[51] Int. Cl.[2] ..... C10G 17/00
[52] U.S. Cl. ..... 208/251 R
[58] Field of Search ..... 208/251 R

[56] References Cited

U.S. PATENT DOCUMENTS 4,048,061 9/1977 Blytas ..... 208/251 R

*Primary Examiner*—Delbert E. Gantz
*Assistant Examiner*—Joseph A. Boska
*Attorney, Agent, or Firm*—Ronald R. Reper

[57] ABSTRACT

A process is disclosed for demetallizing heavy hydrocarbon oils, by contacting the oil at elevated temperature with acidified active carbon. The process is particularly useful as a pretreatment of the heavy hydrocarbons for subsequent catalytic processes which are impared by metals such as nickel and vanadium.

6 Claims, No Drawings

PROCESS FOR DEMETALLIZING OF HEAVY HYDROCARBONS

Related is copending U.S. patent application Ser. No. 673,371 of George C. Blytas, filed Apr. 5, 1976, now U.S. Pat. No. 4,048,061 disclosing the removal of metals such as lead and nickel from light hydrocarbons.

BACKGROUND OF THE INVENTION

A. Field of the Invention

The invention relates to removal of metal contaminants from heavy hydrocarbon stocks such as high boiling point petroleum distillates, shale oils, tar, pitches, residues and crude oil by contacting the hydrocarbon with particulate active carbon which has been pretreated with a highly acidic oxidizing medium.

B. Background of the Invention

Catalytic conversion of heavy hydrocarbons such as shale oils, vacuum distillates from atmospheric distillation of crude petroleum and residual oils has long been technically difficult because of the presence of metal contaminants which result in severe catalyst deactivation. These metal contaminants, which most commonly are nickel and vanadium, generally are found to exist as organometallic compounds of relatively high molecular weight, for example as porphyrins. When a hydrocarbon containing organometallic compound is catalytically treated, the metals and coke become deposited on the catalyst resulting in rapid deactivation of the catalyst.

It has long been known to remove at least a portion of such metals from hydrocarbons by contacting them with various substances such as e.g. bauxite or with metal-containing porous media such as e.g. cobalt molybdate on alumina.

SUMMARY OF THE INVENTION

The invention provides a process for demetallizing heavy hydrocarbon stocks by contacting said stocks at elevated temperatures with a sorbent consisting essentially of particulate active carbon having at least a majority of its pore volume in pores having a diameter greater than 0.9 nanometers (nm), which sorbent has been acidified by contact with a highly acidic oxidizing medium. The process is especially useful for reducing the level of naturally occurring nickel and vanadium compounds in the hydrocarbon prior to subsequent treating by catalytic processes such as catalytic cracking, hydrotreating, hydrodesulfurization, hydrocracking and the like.

DESCRIPTION OF THE PREFERRED EMBODIMENTS

The sorbent according to the invention is a porous active carbon which has been pretreated with a strongly acidic oxidizing medium. The activated carbon starting materials are particulate porous amorphous solids having a majority (40–100%) of its pores with wide diameter, i.e. greater than about 0.9 nanometers (nm) and preferably in the range from about 1.0 to about 15.0 nm, and most preferably from 1.5 to 10 nm as may be determined by isothermal nitrogen desorption measurement at −195°C. Generally, the pores of the active carbon will be increased in size after treatment with strongly acidic oxidizing medium, particularly in the range from about 1.0–2.5 nm.

The contacting of the above active carbon with an oxidizing agent must be carried out in a stongly acidic medium. In some cases the acid itself may be oxidizing e.g., concentrated nitric acid, oleum and to a lesser extent concentrated sulfuric acid, and mixtures of these. It has been found that the use of strong acids such as concentrated hydrochloric acid upon contacting the activated carbon in the absence of an oxidizing agent, is ineffective to produce sorbents having the high activity and capacity of the sorbents produced according to the invention. It is critical to the sorbent of the invention to have an oxygenated surface formed in the presence of a strong acid medium. A wide variety of known oxidizing agents stable in strongly acidic media are known and include e.g., nitrate such as potassium nitrate, chromates, e.g., chromium oxides, and sodium chromate; dichromates such as potassium dichromate; permanganates such as potassium permanganate and the like. The amounts of reactant will vary depending upon the particular active carbon as well as the oxidizing/acidic fluid employed. The reaction fluid may be gaseous e.g., a mixture of oxygen and sulfur trioxide gases, or liquid; excellent results have been obtained with aqueous acids, e.g., at temperatures from about 50° to about 200° C., and preferably from 80°–160° C. Reaction time to oxidize the surface of the carbon with the acidic media may be from 1–2 minutes to 24 hours or more, preferred times are from about 10 to 60 minutes at temperatures of about 30° to about 200° C. Subatmospheric, atmospheric or superatmospheric pressures may be employed. After the reaction is essentially complete, it is highly desirable to substantially separate the acid from the carbon. Although any known technique which does not neutralize the acid-oxidized surface of the active carbon may be used, simple water washing until the pH of the wash water is on the order of 2 to 3 or more has proven effective. The washed carbon is then substantially dried preferably at elevated temperature. Temperatures in the range from about 100°–200° C. are suitable. Vacuum may be employed, if desied. Generally speaking, shorter times are employed at the higher temperatures. However, for some applications such as where the hydrocarbon liquids contain appreciable undissolved water, the carbon need not be completely dried but may contain a few percent or more of water. After the contacting of the active carbon with the strongly acid oxidizing medium the carbon will ordinarily have an increased oxygen content of from at least about 1%w (on carbon) of oxygen and preferably at least about 3%w, up to about 10%w or more.

The heavy hydrocarbon stock to be treated according to the metal removal process of the invention, will generally contain at least a major fraction, i.e. more than about 70% volume and preferably more than 80%v boiling above 343° C. (650° F.), and will include shale and tar sand and coal tar fractions and any of a variety of petroleum oils such as heavy crude oils, long residue, short residue, deasphalted oils, pitches and the like.

The contacting of the hydrocarbon with the acidified active carbon may take place in any known solids-liquids contacting process e.g., by slurrying with subsequent filtration to separate the carbon, however, preferably, and most conveniently, the metals are removed by passing the hydrocarbon stocks through a bed of the acidified active carbon. Suitable temperatures for this contacting may vary from 370° to about 450° C., preferably from about 390° to about 440° C., and most preferably 400°–430° C., at space velocities of 0.5 to about 25 parts by volume (pbv) of feed per pbv of catalyst per hour and preferably from about 1 to about 10.

The contact bed may be in any configuration adapted for the desired flow rate and metal content of the hydrocarbon e.g. upflow, downflow or radial flow either to or from the center of the bed.

The demetallized product of the process of the invention may be suitably employed as a hydrocarbon fuel or as a feedstock for a variety of catalytic conversion processes including e.g. catalytic cracking, hydrotreating, hydrodesulfurization, hydrocracking and the like. The ability of the acidified active carbon to remove heavy metals such as nickel and vanadium from heavy distillates having a final boiling point up to about 510° C. (950° F.) represents a novel means for increasing the portion of long residue (atmospheric distillation residue) which can be used as feed to a catalytic cracking unit, without concomitant increase in metals content of said feed. Although the process of this invention can be used to demetallize the whole vacuum distillate fraction from a long residue, it is preferred to demetallize only the higher boiling fractions of such distillates since those typically contains the majority of the metals in the distillate. Treating of such smaller volume of feed will enable the use of smaller beds of acidified active carbon with attendant reduction in capital and operating costs. Along with the demetallization in the process of the invention, some cracking of the feed occurs particularly at temperatures above about 420° F. In addition, significant denitrification and some desulfurization of the heavy feeds has been observed.

For a fuller understanding of this invention, the following specific examples are given, and are not intended to be considered at limiting, but are to be taken as illustrative of the process described above.

EXAMPLE 1

A commercially available active carbon available under the tradename Filtrasorb 30 from Calgon Division of Merck Chemical having a particle size of 12 × 40 mesh (US) was contacted with a solution of 3.3 parts by weight of concentrated sulfuric acid to one part by weight of concentrated nitric acid in a ratio of 4 cc of solution per gram of carbon at a temperature of about 20°–25° C. which exothermed up to a temperature of about 130° C. After about 20 minutes the carbon was then washed with water until the pH of the washings was 2 or higher, and was dried at 140°–150° C. The resulting acidified active carbon (AAC) was then used in the following examples, except as noted. The acidified active carbon may also be prepared with a wide variety of acidic oxidizing media as shown in the specification and working examples of my copending application Ser. No. 673,311, filed Apr. 5, 1976, and incorporated herein by reference.

EXAMPLE 2

The heavy residual feed for this experiment was a pitch obtained from a Gulf Coast crude oil as the residual portions remaining after both atmospheric distillation to remove the volatile portion boiling at temperatures less than about 343° C. (650° F.), then vacuum flashing to separate additional volatiles having a final atmospheric boiling point up to about 425° C. (797° F.). Forty grams of the pitch which contained 33 ppm nickel and 79 ppm vanadium was placed in an autoclave with the acidified active carbon at solid/liquid weight ratios of about 1 part of solid to 10 parts of liquid, and heated to 400° C. for 5 hours. The pressure increased as a result of cracking reactions. Upon cooling to ambient temperatures the product yielded two phases separable by decantation: a more volatile, less viscous, less dense upper phase which was low in metals and a lower phase whose consistency was at least as great as the starting pitch. The results are summarized in Table I.

COMPARATIVE EXAMPLES 3 AND 4

For comparison, the procedure of Example 2 was repeated except that the acidified active carbon was replaced with a zeolite cracking catalyst, commercially available under the trade designation AR+10, and was repeated again except that no solid solvent was added (thermal treatment). Results are summarized in Table I.

Table I

| Demetallization of Pitch[1] 400° C at 5 hours | | | |
|---|---|---|---|
| | % Volume | | Nickel |
| Example No. | Upper phase | Lower phase | Upper phase |
| 2 (AAC) | ~80 | ~20 | ~5 ppm |
| 3 (AR-10) | ~30 | ~70 | ~4 ppm |
| 4 Thermal | ~30 | ~70 | ~5.5 ppm |

If one assumes that the decantable upper phase of the product corresponds to the distillate portion of the product and the lower phase corresponds to bottoms, it may be seen that the process of the invention yields a higher volume of low-in-metals low density upper phase than either contacting with cracking catalyst or by thermal treatment. Vanadium content of the upper phases in Experiments 2–4 was found to be on the order of 4–5 ppm compared to 79 ppm in the pitch feed.

EXAMPLE 5

The procedure of Experiment 2 was repeated except that the pitch was replaced with a long residue from a Gulf Coast crude and containing about 16 ppm nickel. The upper phase which comprised about 90% volume of the product had a nickel content of about 2–3 ppm. When this experiment was repeated omitting the acidified active carbon, the upper phase was reduced to less than about 80%v of the product.

EXAMPLE 6

To compare the effectiveness of acidified active carbon with thermal treatment, 20 grams of the long residue of Example 5 was placed in each autoclave of a twin autoclave reactor. In addition 5 grams of acidified active carbon was placed in only one of the reactors. The two autoclaves were simultaneously heated by the same heating block up to a temperature of 410° C. for 18 minutes. The autoclave containing the carbon was withdrawn first resulting that the autoclave without the carbon was held at 410° C. for a period of approximately 22 minutes. The feed and products were fractionally distilled and nickel content of the various fractions determined. Results are shown in Table II.

Table II

| Volatile Fractions and Metal Contents of Products from Thermal and AAC Treatment of Long Residue | | | | | | |
|---|---|---|---|---|---|---|
| | Feed[a] | | Thermal | | AAC-Treatment | |
| | % W | ppm Ni | % w | ppm Ni | % w | ppm Ni |
| $<C_9$ | 0.94 | — | 7.48 | — | 8.48 | — |
| Cut I (210° C)[b] | 8.09 | 0.3 | 21.06 | 0.2 | 18.84 | 0.02 |
| Cut II (270° C)[b] | 25.28 | 0.4 | 25.23 | 0.6 | 17.16 | 0.06 |
| Cut III (330° C)[b] | 22.21 | 0.6 | 17.35 | 1.6 | 9.66 | 0.08 |

Table II-continued

Volatile Fractions and Metal Contents of Products from Thermal and AAC Treatment of Long Residue

| | Feed[a] | | Thermal | | AAC-Treatment | |
|---|---|---|---|---|---|---|
| | % W | ppm Ni | % w | ppm Ni | % w | ppm Ni |
| Cut IV (400° C)[b] | 21.19 | 2.0 | 14.01 | 3.5 | 16.65 | 0.2 |
| Bottoms | 22.2 | ~70 | 14.81 | ~100 | 29.19 | 55[c] |

[a]Feed Ni ≈16 ppm

[b]Kettle temperatures at 3-4 mm Hg.

[c]Estimated neglecting nickel sorbent on the AAC.

It may be seen that treatment of the heavy feed with the acidified active carbon results in more extensive cracking than is obtained by thermal treatment alone. The temperature of incipient cracking in the presence of acidified active carbon is lowered by about 100° C. Significantly the metal contents of the volatile fractions obtained by treatment with the acidified active carbon are 5 to 10 times lower than those in fractions obtained by thermal treatment without acidified active carbon. The low levels of metals in such fractions makes them very acceptable feedstocks for further processing by e.g., hydrotreating, cracking and hydrocracking.

What is claimed is:

1. A process for demetallizing heavy hydrocarbon tocks which comprises contacting said stocks at a temperature in the range from about 370° to 450° C. with a sorbent consisting essentially of particulate active carbon having at least a majority of its pore volume in pores having a diameter greater than 0.9 nm, which sorbent has previously been oxidized by contact with a highly acidic oxidizing fluid and substantially separated from said oxidizing fluid.

2. A process as in claim 1 wherein the sorbent has a majority of its pore volume in pores having a diameter in the range from about 1 to about 10 nm.

3. A process as in claim 1 wherein the temperature is from about 390° to about 440° C.

4. A process as in claim 1 wherein the heavy hydrocarbon is a petroleum distillate boiling in the range from about 340° to about 510° C.

5. A process as in claim 1 wherein the heavy hydrocarbon is a residual mineral oil.

6. A process as in claim 1 wherein the heavy hydrocarbon is a petroleum long residue.

* * * * *